United States Patent [19]

Thompson

[11] Patent Number: 4,570,464

[45] Date of Patent: Feb. 18, 1986

[54] JET DYEING APPARATUS

[75] Inventor: Jack E. Thompson, Rocky Mount, N.C.

[73] Assignee: Texfi Industries, Inc., Greensboro, N.C.

[21] Appl. No.: 668,748

[22] Filed: Nov. 6, 1984

[51] Int. Cl.[4] ..... D06B 3/24; D06B 3/28

[52] U.S. Cl. ..... 68/178

[58] Field of Search ..... 68/177, 178

[56] References Cited

U.S. PATENT DOCUMENTS

| | | | |
|---|---|---|---|
| 4,036,038 | 7/1977 | Aurich et al. | 68/178 X |
| 4,114,407 | 9/1978 | Turner et al. | 68/178 |
| 4,129,017 | 12/1978 | Greer | 68/177 X |

*Primary Examiner*—Philip R. Coe

*Attorney, Agent, or Firm*—Bell, Seltzer, Park & Gibson

[57] ABSTRACT

An improved jet dyeing apparatus is provided for dyeing a variety of textile fabrics in rope form, particularly. relatively lightweight and delicate textile fabrics. This apparatus is capable of effectively dyeing such fabrics without causing the rope to be twisted and tangled. Damage of the fabrics and undesired stoppage of the apparatus is thereby avoided.

This improved jet dyeing apparatus includes a jet nozzle tube having a plurality of cutouts adjacent its exit end which allow exiting dye liquor to flow in accelerated fashion and converge on the rope of textile material while the rope is passing through the nozzle tube and being contacted and directed thereby. The dye liquor stream converges on the rope at an angle of no greater than about 30 degrees whereby a relatively gentle action is imparted by the dye liquor as it converges on the rope.

13 Claims, 10 Drawing Figures

JET DYEING APPARATUS

FIELD OF THE INVENTION

This invention relates to improved jet dyeing apparatus adapted for dyeing relatively lightweight and delicate textile fabrics in rope form. More particularly, this invention is directed to jet dyeing apparatus having a jet nozzle tube and associated apparatus adapted to avoid twisting and tangling of the fabric being dyed therein.

BACKGROUND OF THE INVENTION

Jet dyeing apparatus such as shown in U.S. Pat. Nos. 2,978,291 and 3,780,544 have heretofore been utilized extensively and generally successfully in the dyeing or wet processing of textile fabric in endless rope form. "Jet" processing typically involves circulation of a rope of textile material through a dye bath under the influence of a rapidly moving jetted portion of a liquid dye bath which impinges upon and strikes the rope at an angle of some 45° or greater. The jet influence of the dye liquor speeding up as it passes through a reduced size passageway aids in moving the rope of material through the dyeing apparatus while also effecting sharp penetration of the dye liquor through the fabric.

Although a forceful dye liquor jetting action is desired for fabric movement and dye penetration, it can produce very undesirable results in the treatment of the more modern lightweight and delicate fabrics. All too often treatment of these newer fabrics in jet dyeing apparatus results in the fabric being abraded and damaged and in the rope of fabric being tangled and twisted to the point of requiring premature shutdown and dismantling of the dyeing apparatus to clear the stalled rope of fabric. Attempts have been previously made at solving the problems presented in handling lightweight fabrics, such as described in U.S. Pat. No. 4,114,407, wherein there is substantially little, if any, impingement of the rope of fabric by the jetted dye bath and wherein the dyeing tube is downwardly inclined, but not until the present invention have any been truly successful. These problems are more particularly discussed below in association with the description of the illustrated embodiments.

SUMMARY OF THE INVENTION

It is accordingly an object of the present invention to provide improved apparatus for dyeing textile material in rope form wherein there is provided a housing means defining a cylindrical dye liquor chamber and a cylindrical nozzle tube mounted concentrically and longitudinally adjustable therein. In one embodiment of the invention, means for redirecting the flow of the dye liquor from the outflow section of the dye liquor chamber to a path of flow between the redirecting means and the outflow section of the nozzle tube is provided and held between the outflow sections of the dye liquor chamber and the nozzle tube. The nozzle tube has a plurality of cutouts adjacent its exit end which cooperate with the dye liquor redirecting means to form an outflow dye liquor passageway wherethrough the dye liquor may flow in accelerated fashion and converge on the rope of textile material while the rope is passing through the nozzle tube and contacted by portions thereof. This contact assists in preventing the rope from unduly twisting and turning upon being subjected to the forces of the dye liquor stream. The dye liquor redirecting means is so configured and positioned that its side wall forms an acute angle of no greater than about 30 degrees (desirably about 27 degrees) with the longitudinal axis of the nozzle tube whereby a relatively gentle action is imparted by the dye liquor as it passes through the dye liquor redirecting means and converges on the rope of textile material.

The dye liquor redirecting means can take the form of a hollow frusto-conical ring which is positioned within the dye liquor chamber with its larger diameter facing upstream and with its smaller diameter exit end contacting the interior wall of the outflow section of the dye liquor chamber to aid in aligning the nozzle tube concentrically within the housing means and maintaining it in such alignment.

In another embodiment of the invention separate dye liquor redirecting means is not required and instead there is provided specially configured housing means defining a dye liquor chamber with the desired profile. The interior wall of the outflow section of the dye liquor chamber forms an acute angle of no greater than about 30 degrees (desirably about 27 degrees) with the longitudinal axis of the nozzle tube.

Preferably, in the case of either embodiment the outflow section of the nozzle tube tapers down to a cylindrical exit portion and includes a plurality of cutouts which predominantly cut away the exit portion and define elongate narrow fingerlike members between adjacent cutouts. These fingerlike members can have rounded ends and be circularly arranged and flexible such that longitudinal adjustment of the nozzle tube within the housing means toward the exit end of the dye liquor chamber causes the fingerlike members to be biased inwardly toward the longitudinal axis of the nozzle tube whereby the size of the outflow dye liquor passageway may be varied as desired in order to best accommodate different types of textile fabric.

BRIEF DESCRIPTION OF THE DRAWINGS

Further and more specific features and advantages of the invention will become more apparent when taken in connection with the accompanying drawings, in which—

DETAILED DESCRIPTION OF THE ILLUSTRATED EMBODIMENT

While the present invention will be described more fully hereinafter with reference to the accompanying drawings, in which particular forms of carrying out the present invention are shown, it is to be understood at the outset of the description which follows that persons of skill in the appropriate arts may modify the forms of the invention here described while still achieving the favorable results of this invention. Accordingly, the description which follows is to be understood as being a broad, teaching disclosure directed to persons of skill in the appropriate arts, and not as limiting upon the present invention.

Figure 1:
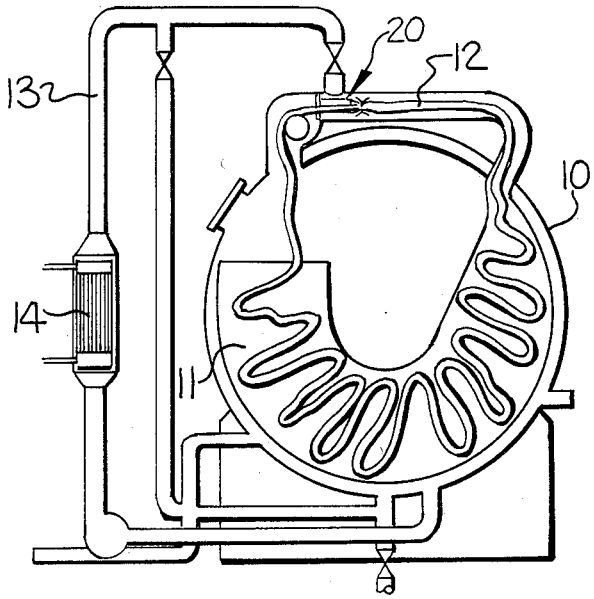
Fig-1 PRIOR ART
FIG. 1 is an environmental view in partially schematic form illustrating representative jet dyeing apparatus embodying prior art apparatus for jetting the dye liquor.

Referring now more specifically to the drawings, FIG. 1 generally illustrates representative jet dyeing apparatus which includes a kier 10 for containing dye liquor 11 and an endless rope of textile material 12 being dyed, as well as associated piping 13 and heat source 14. Also included in the apparatus of FIG. 1 is prior art jetting apparatus 20 which is shown in more detail in FIGS. 2 and 3.

Jetting apparatus 20 includes dye liquor inlet port P associated with housing means 21. Housing means 21 defines a generally cylindrical shaped dye liquor chamber 22 having a tapered outflow section **22*a* which terminates in a reduced diameter exit end 22*b*. A hollow generally cylindrical shaped nozzle tube 23 is mounted within chamber 22 and receives the rope 12** therein.

In operation of prior art jetting apparatus 20, dye liquor 11 is pumped through port P and into dye liquor chamber 22 from which it flows out exit end **22*b*. The velocity of dye liquor 11 increases as it flows toward exit end 22*b* since the area available for flow is reduced. The fast-moving dye liquor 11 thus converges on the rope of textile material 12 exiting nozzle tube 23 and causes it to be moved along downstream while the dye liquor 11 also penetrates rope 12**.

Figure 2:
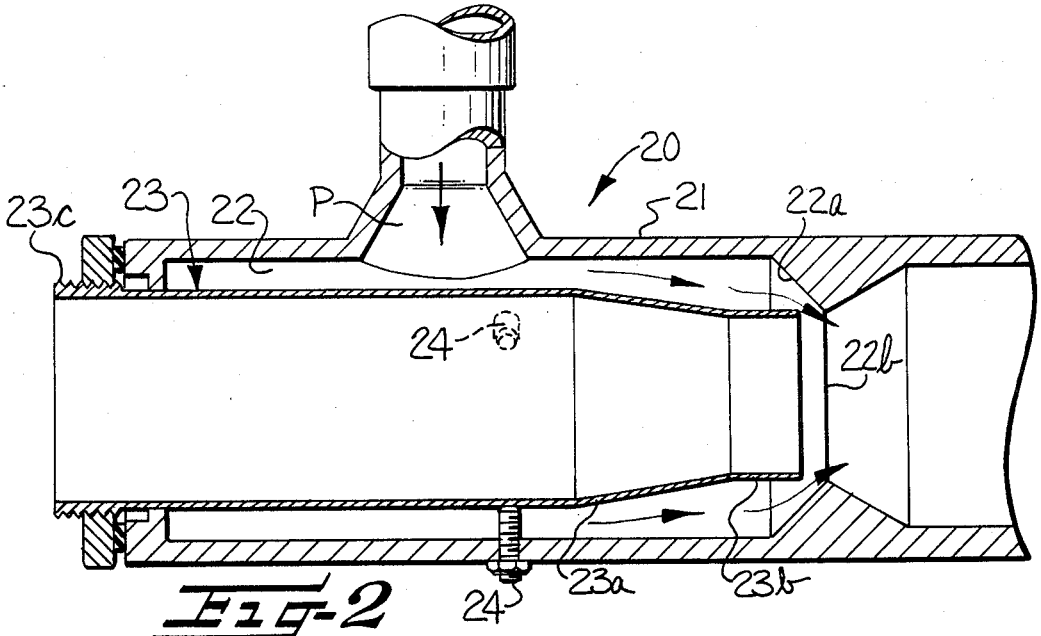
Fig-2 PRIOR ART
FIG. 2 is an enlarged longitudinal cross-sectional view of the prior art jetting apparatus embodied in the jet dyeing apparatus of FIG. 1.

In the past it has often been desired to have the stream of dye liquor 11 sharply converge on rope 12 to maximize dye penetration such that as shown in FIG. 2 the interior wall of the dye liquor chamber outflow section forms a relatively steep angle of about 45 degrees with the longitudinal axis of nozzle tube 23.

As shown in FIG. 2 nozzle tube 23 is installed and held in chamber 22 by screwing a threaded end **23*c* into a threaded receiving position of chamber 22. Nozzle tube 23 is usually positioned such that nozzle tube end 23*b* is spaced apart from the interior wall of the dye liquor chamber outflow section a predetermined distance. In one example of the prior art this distance is 3/32" with chamber 22 having a 4" inside diameter and nozzle tube 23 having an outside diameter of about $3\frac{1}{4}$". Prior art apparatus 20 also usually is provided with one or several threaded studs 24 located in chamber 22 to contact and support nozzle tube 23**.

In practice it is extremely difficult to accurately locate nozzle tube 23 in chamber 22 as desired in prior art apparatus 20. Setting the interior space between nozzle tube end **23*b* and the interior of the chamber outflow section 22*a* is a "blind" adjustment that can only be approximated as is similarly the adjustment of studs 24 to locate nozzle tube 23 truly concentrically within chamber 22**. This lack of verifiable accuracy leads to substantial problems since these adjustments are critical.

Figure 3:
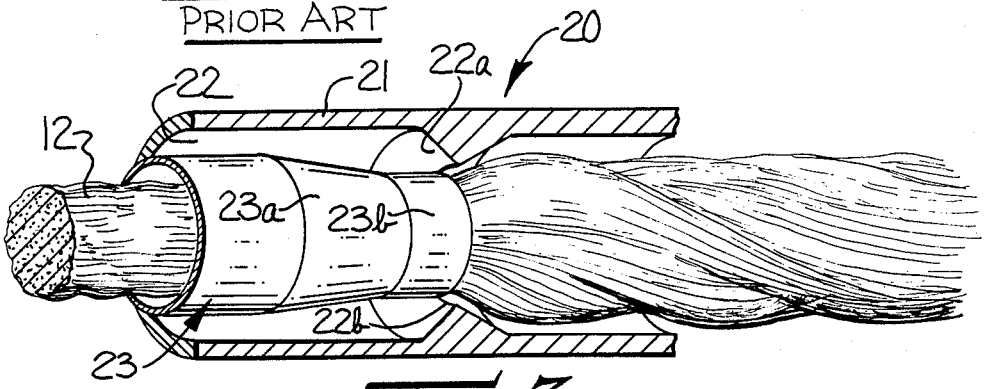
Fig-3 PRIOR ART
FIG. 3 is a schematic cross-sectional view similar to FIG. 2 illustrating the prior art jetting apparatus in operation.

Specifically, if the gap space between tube end **23*b* and chamber wall 22*b* is either much greater or much less than the optimum desired, prior art apparatus 20 simply will not properly operate. The space may be so small that dye liquor flow will be insufficient and if the space is too great there will not be sufficient dye liquor/rope interaction. With regard to the concentricity of nozzle 23, it must first be realized that even under optimum conditions the dye liquor flow around nozzle tube end 23*b* is not going to be uniform. Likewise, rope 12 is not truly uniform along its length such that even under best conditions in prior art apparatus 20 there will always be some amount of twisting and turning of rope 12 as it is contacted by the jetting dye liquor 11**, as is shown in FIG. 3.

Since the dye liquor forces are relatively harsh in any event, when they become imbalanced they can easily be such that they will abrade and harm the fabric of rope 12. A small amount of imbalance likewise can cause rope 12 to be so turned, twisted and tangled that the jet dyeing device must be shut down and cleared. Unless nozzle tube 23 can be installed and maintained truly concentrically (a practical impossibility) such excessive imbalance is inevitable as are the corresponding shutdowns.

Figure 4:
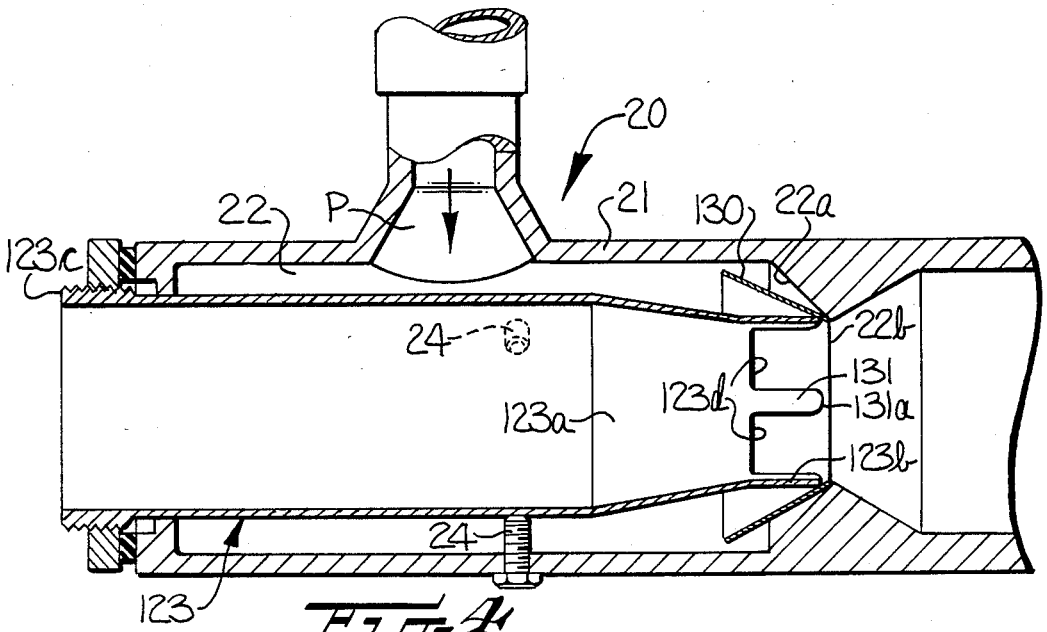
FIG. 4 is a longitudinal cross-sectional view similar to FIG. 2 illustrating an embodiment of the jetting apparatus of the invention.
Figure 5:
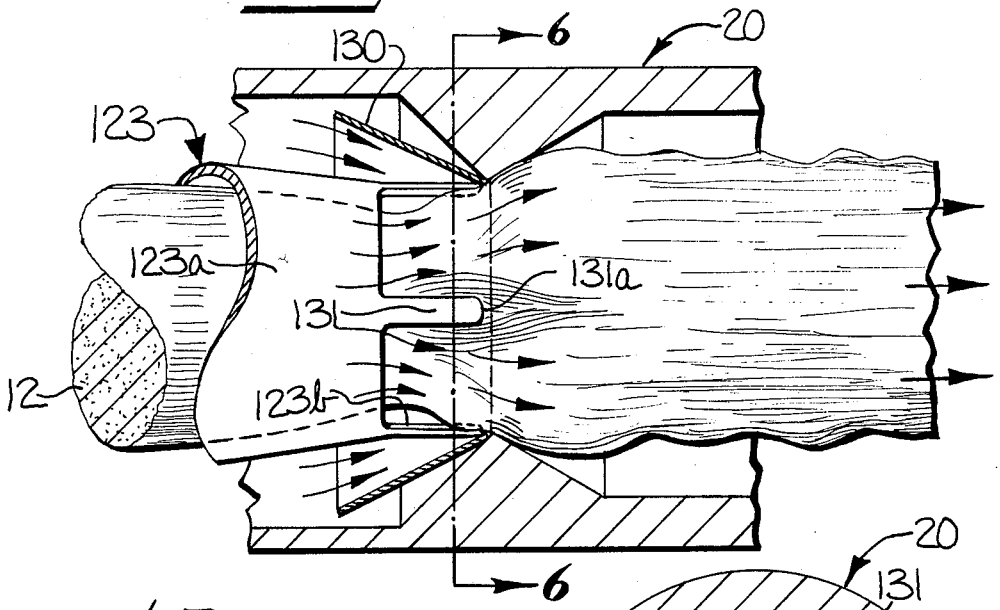
FIG. 5 is an enlarged partial longitudinal cross-sectional view illustrating the apparatus of FIG. 4 in operation.
Figure 6:
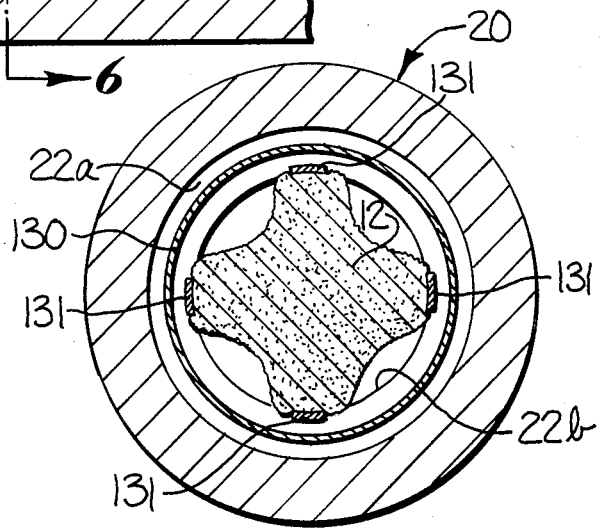
FIG. 6 is a vertical cross-sectional view taken along line 6—6 of FIG. 5.
Figure 7:
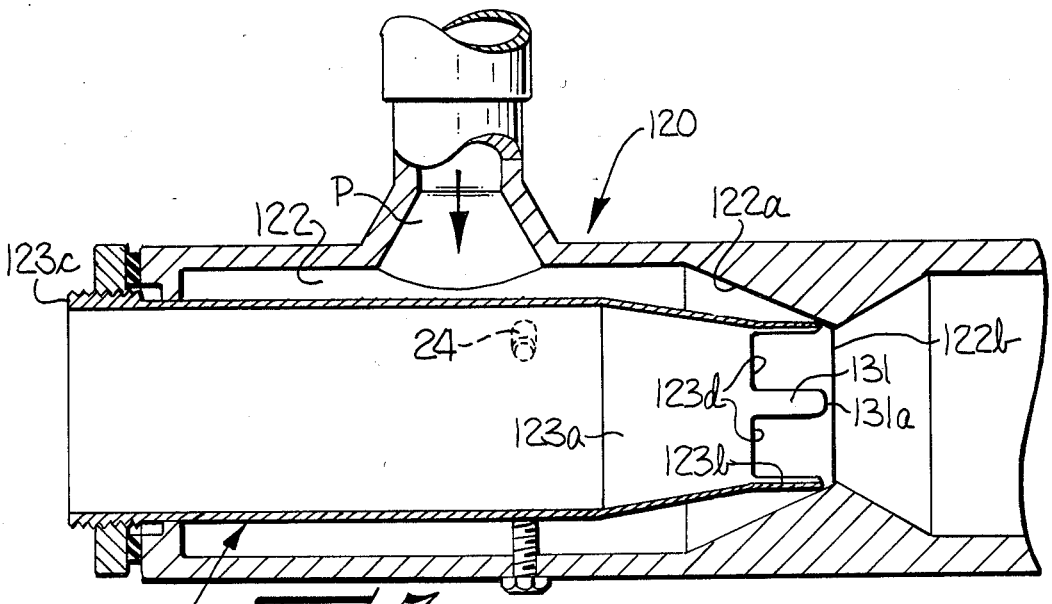
FIG. 7 is a longitudinal cross-sectional view similar to FIG. 4 illustrating another embodiment of the jetting apparatus of the invention.

These problems are met in several ways by the subject invention, one embodiment of which is shown in FIGS. 4 through 6. This embodiment is designed to remedy the problems of the prior art at minimum expense utilizing as much of the prior art apparatus as possible.

This embodiment 120 thus also includes port and housing means 21 which defines the same dye liquor chamber 22 with tapered outflow section **22*a* terminating in reduced diameter exit end 22*b*. A hollow generally cylindrical shaped nozzle tube 123 with tapered outflow section 123*a* and reduced diameters exit end 123*b* is likewise mounted within chamber 22 to receive rope 12** therein.

As shown in FIG. 3, nozzle tube 123 is mounted concentrically within housing means 21 in spaced-apart relation thereto forming a dye liquor passageway therebetween. Nozzle tube 123 is longitudinally adjustable within housing means 21 through rotation of threaded end **123*c*. The outflow section 123*a* of nozzle tube 123 is positioned adjacent to and inwardly from the outflow section 122*a* of the dye liquor chamber 122. Nozzle tube 123 thus resembles conventional nozzle tube 23 but includes a plurality of cutouts 123*d*** therein adjacent the exit end thereof.

In the case of this embodiment of the invention, however, there is provided means to redirect the dye liquor in from the flow path of the prior art. This redirecting means is positioned and held between and contacts the respective outflow sections **122*a* and 123*a* of dye liquor chamber 122 and nozzle tube 123. As shown, this redirecting means desirably is a hollow frusto-conical ring 130. It is positioned with its larger diameter facing upstream and away from the exit ends 122*b* and 123*b* of dye liquor chamber 122 and nozzle tube 123. Ring 130 serves to redirect the flow of the dye liquor 11 from the outflow section 122*a* of dye liquor chamber 122 to between the interior of the ring 130 and the outflow section 123*a* of nozzle tube 123. The shape of ring 130** is such that the angle formed between the interior of ring 130 and the longitudinal axis of the nozzle tube 123 is no greater than about 30 degrees and is desirably about 27 degrees.

As noted the exit end 123*b* of nozzle tube 123 contacts the interior of ring 130 and ring 130 contacts the interior wall of the dye liquor chamber outflow section 122*a*. This provides a positive means of positioning nozzle tube 123 and ensuring that it is concentric within chamber 22. Studs 24 are still provided although nozzle tube 123 is essentially self-centering.

The outflow section 123*a* of nozzle tube 123 tapers down to a cylindrically shaped exit portion 123*d* of a predetermined length and includes a plurality of cutouts 123*d* adjacent exit end 123*b*. As shown in FIGS. 4 and 5, cutouts 123*d* allow free flow through of dye liquor 11 and are of such shape and size that they define narrow finger-like members 131 between adjacent cutouts. These finger-like members 131 are flexible and circularly arranged and serve to contact and guide the rope of fabric 12 as it exits nozzle tube 123 as shown in FIG. 6. Fingerlike members 131 have rounded ends 131*a* to avoid snagging the passing rope of fabric 12.

With a dye liquor chamber 22 with an internal diameter of about 4 degrees and a nozzle tube 123 with an external diameter of its larger diameter portion of about $3\frac{1}{4}''$, there are desirably provided four substantially equally spaced-apart elongate members 131 each being about $1\frac{1}{4}''$ long and about $\frac{5}{8}''$ wide and laterally spaced about 2" apart.

A second embodiment of the invention is shown in FIGS. 7 through 10 which also includes nozzle tube 123 of the first embodiment but which utilizes housing means 121 designed to define dye liquor chamber 122 of desired shape. With chamber 122 it is unnecessary to provide ring 130 to redirect dye liquor flow since chamber 122 itself is provided with the desired profile. Specifically, in chamber 122 the angle formed between the interior wall of the chamber outflow section 122*a* and the longitudinal axis of nozzle tube 123 is an acute angle no greater than about 30 degrees and desirably about 27 degrees.

Otherwise, the second embodiment generally corresponds with the first with nozzle tube 123 likewise being mounted concentrically within housing means 121 and longitudinally adjustable therein through rotation of threaded end 123*c*. The outflow section 123*a* of nozzle tube 123 is similarly positioned adjacent to and inwardly from the outflow section 122*a* of dye liquor chamber 122 and exit end 123*b* of nozzle tube 123 contacts the interior wall of this outflow section 122*a* to aid in positively positioning and concentrically aligning nozzle tube 122 within housing means 121.

Figure 9:
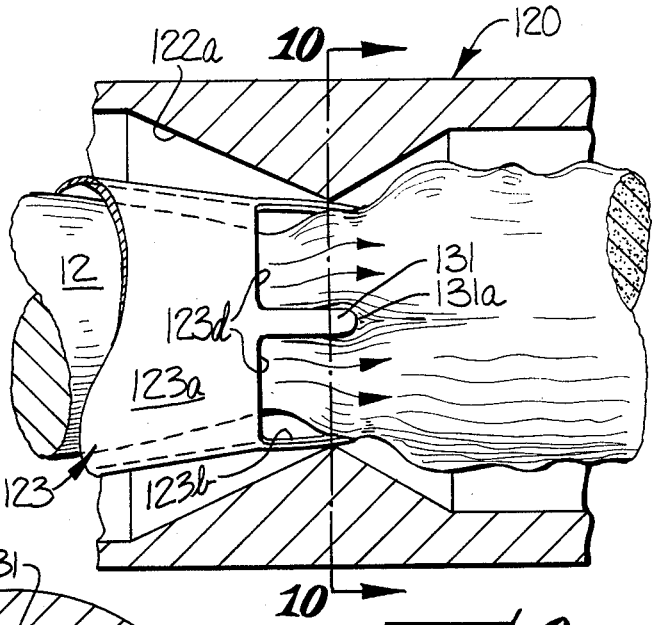
FIG. 9 is an enlarged partial longitudinal cross-sectional view illustrating the apparatus of FIGS. 7 and 8 in operation.
Figure 10:
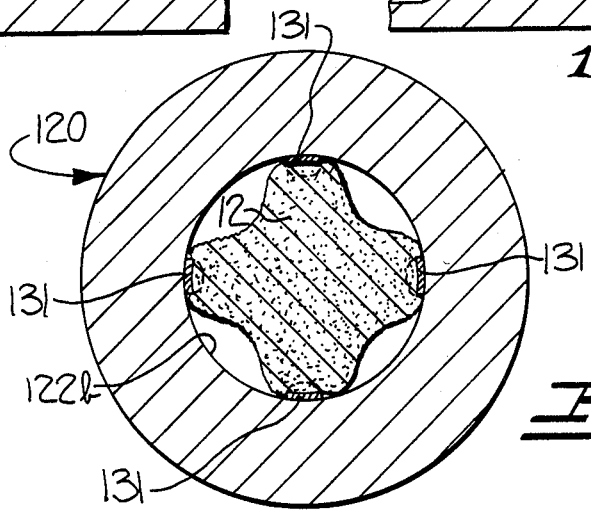
FIG. 10 is a vertical cross-sectional view taken along line 10—10 of FIG. 9.

In operation the embodiments of FIGS. 5 and 9 both present significant advantages over the prior art that result in improved superior performance, particularly in dyeing relatively lightweight and delicate fabrics. First of all as already stated by having the exit end 122*b* of nozzle tube 122 positively contact the interior structure during installation results in greater assurance that nozzle tube 123 will remain concentric in operation and the dye liquor forces uniform.

Additionally, nozzle tube cutouts 123*d* form outflow dye liquor passageways that permit more gradual and less harsh dye liquor contact with rope 12 which likewise helps in minimizing fabric abrasion and rope twisting. This moderation of action is enhanced by the relatively shallow angle of the dye liquor stream. And as shown in FIGS. 5 and 9 the fingerlike members 131 likewise aid in stabilizing the rope 12 and maintaining it in substantially linear and untwisted form.

Figure 8:
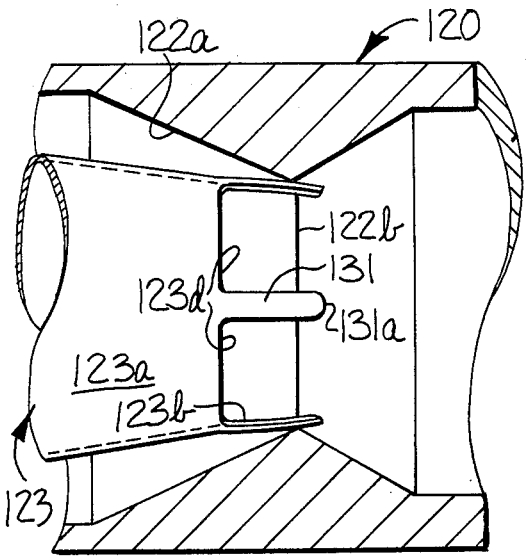
FIG. 8 is an enlarged partial longitudinal cross-sectional view illustrating longitudinal adjustment of the nozzle tube of FIG. 7.

Moreover, since members 131 are elongate and flexible they are capable of being biased inwardly upon contacting the interior of the chamber outflow section as shown in FIGS. 8 and 9 such that nozzle tube 123 is capable of relatively substantial longitudinal adjustment. The size of the outflow dye liquor passageway can thus be varied in width and length to vary the desired flow of dye liquor to better accommodate various types of textile fabric such as that ranging from 4 to 14 ounces per yard. These adjustments may be made relatively precisely with predictable results and do not so critically alter performance as do the settings of the prior art apparatus.

In the drawings and specification, there have been disclosed typical preferred embodiments of the invention, and although specific terms are employed, they are used in a generic and descriptive sense only and not for purposes of limitation.

That which is claimed is:

1. In apparatus for dyeing textile sheet material in endless rope form in which a stream of dye liquor is utilized to converge on the rope of textile material to penetrate and dye same and also cause the rope of material to pass through the dyeing apparatus, the improvement comprising:

housing means defining a generally cylindrical shaped dye liquor chamber having a tapered outflow section which terminates in a reduced diameter exit end;

a hollow generally cylindrical shaped nozzle tube for passage of the rope of textile material therethrough mounted concentrically within said housing means in spaced-apart relation thereto and forming a dye liquor passageway therebetween, said nozzle tube being longitudinally adjustable within said housing means and said nozzle tube also having a tapered outflow section which terminates in a reduced diameter exit end, the outflow section of said nozzle tube being positioned adjacent to and inwardly from the outflow section of said dye liquor chamber;

dye liquor redirecting means positioned and held between and contacting the respective outflow sections of said dye liquor chamber and said nozzle tube for redirecting the flow of the dye liquor from the outflow section of said dye liquor chamber to a path of flow between said redirecting means and the outflow section of said nozzle tube;

said nozzle tube having a plurality of cutouts adjacent the exit end thereof which cooperate with the surrounding dye liquor redirecting means to form an outflow dye liquor passageway wherethrough the dye liquor may flow in accelerated fashion and converge on the rope of textile material while the rope is passing through the nozzle tube and contacted by portions thereof so that the rope does not unduly twist and turn upon being subjected to the flow of dye liquor, and wherein the angle formed between the interior of said dye liquor redirecting means and the longitudinal axis of said nozzle tube is an acute angle and is no greater than about 30 degrees whereby a relatively gentle action is imparted by the dye liquor as it passes through the dye liquor redirecting means and converges on the rope of textile material.

2. In apparatus for dyeing textile material in endless rope form, the improvement defined in claim 1 wherein the dye liquor redirecting means comprises a hollow frusto-conical ring which has its larger diameter facing upstream and away from the respective exit ends of said dye liquor chamber and the nozzle tube and with its smaller diameter exit end contacting the interior wall of the outflow section of said dye liquor chamber to aid in concentrically aligning said nozzle tube within said housing means.

3. In apparatus for dyeing textile material in endless rope form, the improvement defined in claim 2 wherein the outflow section of said nozzle tube tapers down to a cylindrical shaped exit portion of a predetermined length which includes the plurality of cutouts adjacent the exit end of the nozzle tube with the cutouts being of such predetermined shape and size that the exit portion is predominantly cut away to allow free flow-through of dye liquor.

4. In apparatus for dyeing textile material in endless rope form, the improvement defined in claim 3 wherein the cutouts in the exit portion of said nozzle tube define elongate narrow fingerlike members between adjacent cutouts, said fingerlike members having rounded ends and being circularly arranged and flexible such that longitudinal adjustment of said nozzle tube within said housing means in a direction toward the exit end of said dye liquor chamber causes said fingerlike members to be biased inwardly toward the longitudinal axis of said nozzle tube whereby the size of the outflow dye liquor passageway may be varied to permit varying the rate of flow of the dye liquor so as to more finitely adjust same to accommodate various types of textile fabric to be dyed, and said fingerlike members further serving to assist in maintaining the rope of textile material from twisting and tangling.

5. In apparatus for dyeing textile material in endless rope form, the improvement defined in claim 4 wherein the internal diameter of the dye liquor chamber is about 4" and the external diameter of the larger diameter portion of the nozzle tube is about $3\frac{1}{4}$" and wherein said fingerlike members are four in number and are substantially equally spaced-apart, and each of which is about $1\frac{1}{4}$" long and about $\frac{5}{8}$" wide.

6. In apparatus for dyeing textile material in endless rope form, the improvement defined in claim 2 wherein the acute angle formed between the interior wall of said frusto-conical ring and the longitudinal axis of said nozzle tube is about 27 degrees.

7. In apparatus for dyeing textile sheet material in endless rope form in which a stream of dye liquor is utilized to converge on the rope of textile material to penetrate and dye same and also cause the rope of material to pass through the dyeing apparatus, the improvement comprising:

housing means defining a generally cylindrical shaped dye liquor chamber having a tapered outflow section which terminates in a reduced diameter exit end;

a hollow generally cylindrical shaped nozzle tube for passage of the rope of textile material therethrough mounted concentrically within said housing means in spaced-apart relation thereto and forming a dye liquor passageway therebetween, said nozzle tube being longitudinally adjustable within said housing means and said nozzle tube also having a tapered outflow section which terminates in a reduced diameter exit end, the outflow section of said nozzle tube being positioned adjacent to and inwardly from the outflow section of said dye liquor chamber;

dye liquor redirecting means positioned and held between the respective outflow sections of said dye liquor chamber and said nozzle tube for redirecting the flow of the dye liquor from the outflow section of said dye liquor chamber, said redirecting means having an exit end adjacent the exit end of said dye liquor chamber which contacts the interior wall of said dye liquor chamber to aid in concentrically aligning said nozzle tube within said housing means;

the outflow section of said nozzle tube tapering down to a cylindrical shaped exit portion of a predetermined length which includes a plurality of cutouts adjacent the exit end thereof which cooperate with the surrounding dye liquor redirecting means to form an outflow dye liquor passageway wherethrough the dye liquor may flow in accelerated fashion and converge on the rope of textile material while the rope is passing through the nozzle tube and contacted by portions thereof so that the rope does not unduly twist and turn upon being subjected to the dye liquor, and wherein the angle formed between the interior of said dye liquor redirecting means and the longitudinal axis of said nozzle tube is an acute angle and is no greater than about 30 degrees whereby a relatively gentle action is imparted by the dye liquor as it passes through the dye liquor redirecting means and converges on the rope of textile material;

the cutouts in the exit portion of said nozzle tube being substantially equally spaced and shaped to define four elongate narrow fingerlike members between adjacent cutouts, said fingerlike members having rounded ends and being circularly arranged and flexible such that longitudinal adjustment of said nozzle tube within said housing means in a direction toward the exit end of said dye liquor chamber causes said fingerlike members to be biased inwardly toward the longitudinal axis of said nozzle tube whereby the size of the outflow dye liquor passageway may be varied to permit varying the rate of flow of the dye liquor so as to more finitely adjust same to accommodate various types of textile fabric to be dyed, and said fingerlike members further serving to assist in maintaining the rope of textile material from twisting and tangling.

8. In apparatus for dyeing textile material in endless rope form in which a stream of dye liquor is utilized to converge on the rope of textile material to penetrate and dye same and also cause the rope of material to pass through the dyeing apparatus, the improvement comprising:

housing means defining a generally cylindrical shaped dye liquor chamber having a tapered outflow section which terminates in a reduced diameter exit end;

a hollow generally cylindrical shaped nozzle tube for passage of the rope of textile material therethrough mounted concentrically within said housing means in spaced-apart relation thereto and forming a dye liquor passageway therebetween, said nozzle tube being longitudinally adjustable within said housing means and said nozzle tube also having an outflow section which terminates in a reduced diameter exit end, the outflow section of said nozzle tube being positioned adjacent to and inwardly from the outflow section of said dye liquor chamber and with the exit end of said nozzle tube contacting the interior wall of the outflow section of said dye liquor chamber to aid in concentrically aligning said nozzle tube within said housing means;

said nozzle tube having a plurality of cutouts adjacent the exit end thereof which cooperate with the surrounding ouflow section of said dye liquor chamber to form an outflow dye liquor passageway wherethrough the dye liquor may flow in accelerated fashion and converge on the rope of textile material while the rope is passing through the nozzle tube and contacted by portions thereof so that the rope does not unduly twist and turn upon being subjected to the dye liquor, and wherein the angle formed between the interior wall of the outflow section of said dye liquor chamber and the longitudinal axis of said nozzle tube is an acute angle and is no greater than about 30 degrees whereby a relatively gentle action is imparted by the dye liquor as it passes through the chamber and converges on the rope of textile material.

9. In apparatus for dyeing textile material in endless rope form, the improvement defined in claim 8 wherein the outflow section of said nozzle tube tapers down to a cylindrical shaped exit portion of a predetermined length which includes the plurality of cutouts adjacent the exit end of the nozzle tube with the cutouts being of such predetermined shape and size that the exit portion is predominantly cut away to allow free flow-through of dye liquor.

10. In apparatus for dyeing textile material in endless rope form, the improvement defined in claim 9 wherein the cutouts in the exit portion of said nozzle tube define elongate narrow fingerlike members between adjacent cutouts, said fingerlike members having rounded ends and being circularly arranged and flexible such that longitudinal adjustment of said nozzle tube within said housing means in a direction toward the exit end of said dye liquor chamber causes said fingerlike members to be biased inwardly toward the longitudinal axis of said nozzle tube whereby the size of the outflow dye liquor passageway may be varied to permit varying the rate of flow of the dye liquor so as to more finitely adjust same to accommodate various types of textile fabric to be dyed, and said fingerlike members further serving to assist in maintaining the rope of textile material from twisting and tangling.

11. In apparatus for dyeing textile material in endless rope form, the improvement defined in claim 10 wherein the internal diameter of the dye liquor chamber is about 4" and the external diameter of the larger diameter portion of the nozzle tube is about $3\frac{1}{4}$" and wherein said fingerlike members are four in number and are substantially equally spaced-apart, and each of which is about $1\frac{1}{4}$" long and about $\frac{5}{8}$" wide.

12. In apparatus for dyeing textile material in endless rope form, the improvement defined in claim 8 wherein the acute angle formed between the interior wall of the outflow section of said dye liquor chamber and the longitudinal axis of said nozzle tube is about 27 degrees.

13. In apparatus for dyeing textile material in endless rope form in which a stream of dye liquor is utilized to converge on the rope of textile material to penetrate and dye same and also cause the rope of material to pass through the dyeing apparatus, the improvement comprising:

housing means defining a generally cylindrical shaped dye liquor chamber having a tapered outflow section which terminates in a reduced diameter exit end;

a hollow generally cylindrical shaped nozzle tube for passage of the rope of textile material therethrough mounted concentrically within said housing means in spaced-apart relation thereto and forming a dye liquor passageway therebetween, said nozzle tube being longitudinally adjustable within said housing means and said nozzle tube also having an outflow section which terminates in a reduced diameter exit end, the outflow section of said nozzle tube being positioned adjacent to and inwardly from the outflow section of said dye liquor chamber and with the exit end of said nozzle tube contacting the interior wall of the outflow section of said dye liquor chamber to aid in concentrically aligning said nozzle tube within said housing means;

said nozzle tube having a plurality of cutouts adjacent the exit end thereof which cooperate with the surrounding outflow section of said dye liquor chamber to form an outflow dye liquor passageway wherethrough the dye liquor may flow in accelerated fashion and converge on the rope of textile material while the rope is passing through the nozzle tube and contacted by portions thereof so that the rope does not unduly twist and turn upon being subjected to the dye liquor, and wherein the angle formed between the interior wall of the outflow section of said dye liquor chamber and the longitudinal axis of said nozzle tube is an acute angle and is no greater than about 30 degrees whereby a relatively gentle action is imparted by the dye liquor as it passes through the chamber and converges on the rope of textile material;

the outflow section of said nozzle tube tapering down to a cylindrical shaped exit portion of a predetermined length which includes the plurality of cutouts adjacent the exit end of the nozzle tube with the cutouts being substantially equally spaced and shaped such that the exit portion is predominantly cut away to allow free flowthrough of dye liquor and such that four elongate narrow fingerlike members are defined between said cutouts, said fingerlike members having rounded ends and being circularly arranged and flexible such that longitudinal adjustment of said nozzle tube within said housing means in a direction toward the exit end of said dye liquor chamber causes said fingerlike members to be biased inwardly toward the longitudinal axis of said nozzle tube whereby the size of the outflow dye liquor passageway may be varied to permit varying the rate of flow of the dye liquor so as to more finitely adjust same to accommodate various types of textile fabric to be dyed and said fingerlike members further serving to assist in maintaining the rope of textile material from twisting and tangling.

* * * * *